US006252921B1

(12) United States Patent
Michaudon

(10) Patent No.: US 6,252,921 B1
(45) Date of Patent: Jun. 26, 2001

(54) NUCLEAR ISOMERS AS NEUTRON AND ENERGY SOURCES

(75) Inventor: AndréMichaudon, Santa Fe, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 09/087,730

(22) Filed: May 29, 1998

(51) Int. Cl.[7] ..... G21G 1/00; G21G 4/02
(52) U.S. Cl. ..... 376/156; 376/158; 376/189
(58) Field of Search ..... 376/156, 158, 376/189

(56) References Cited

PUBLICATIONS

A. Michaudon, "Nuclear Fission," Advances in Nuclear Physics, M. Baranger and E. Vogt, Eds. (Plenum Press, 1973), vol. 6, p. 1.
Robert V. F. Janssens et al., "Superdeformed Nuclei," Annu. Rev. Nucl. Part. Sci. 41, 321 (1991).
S. J. Krieger et al., "Super–Deformation and Shape Isomerism: Mapping the Isthmus," Nucl. Phys. A542, 43 (1992).
Michel Girod et al., "Isoméres De Forme Dans Les Noyaux Pairs–Pairs: Premiére Sèlection De Candidats Dans La Règion De Masses A <208," Centre d'Etudes de Bruyéres–le–Châtel Note No. CEA–N–2560 (May, 1998).

*Primary Examiner*—Michael J. Carone
*Assistant Examiner*—Kyongtack K. Mun
(74) *Attorney, Agent, or Firm*—Samuel M. Freund

(57) ABSTRACT

The present invention includes the use of N-isomers as a source of energy and of neutrons, and the use of K-isomers as a source of energy when associated with a source of neutrons. Although there is strong indirect evidence for the existence of shape isomers in nuclei lighter than actinides, super-deformed (SD) isomeric states have not yet been directly observed. However, rotational bands from such SD states have been observed through γ-ray transitions within high-energy rotational states of this band, as populated by HI reactions. The lifetimes for the shape isomers are likely to be small, but may be increased by effects like the odd-even effects already observed for fission isomers. By contrast, K-isomers have been observed and investigated. If N-isomers are found with the required properties (especially with sufficiently long lifetimes) and produced in sufficient quantities, portable neutron sources more intense than existing neutron sources could be obtained. Neutrons from these sources could also be used to produce energy by using a variety of neutron-induced reactions in selected materials added to the N-isomers, such as K-isomers, which release energy after interacting with neutrons.

5 Claims, 1 Drawing Sheet

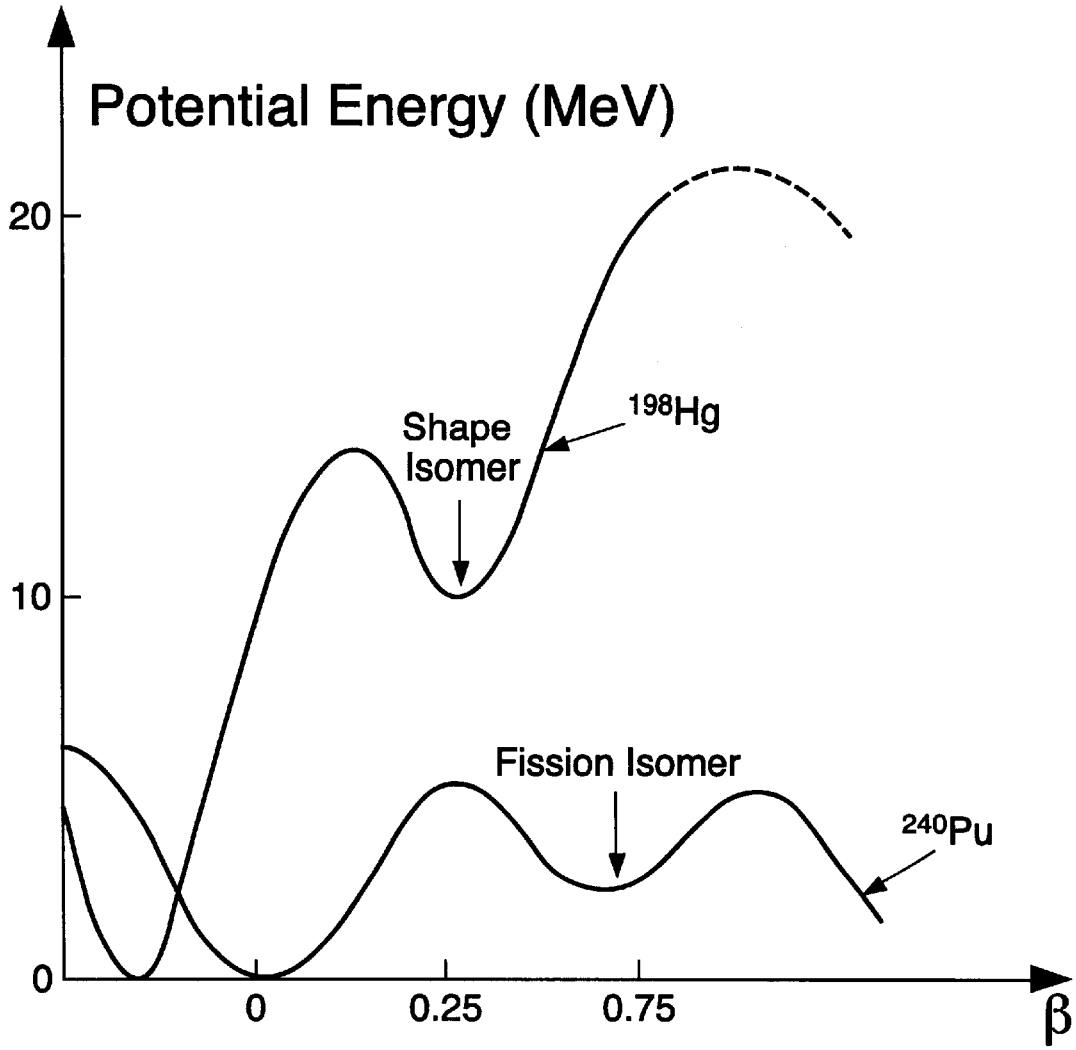
FIGURE

NUCLEAR ISOMERS AS NEUTRON AND ENERGY SOURCES

FIELD OF THE INVENTION

The present invention relates generally to the release of energy stored in excited nuclear matter and neutrons and, more particularly, to the use of long-lived, superdeformed states in nuclei, which have sufficient stored excitation energy, as neutron and energy sources, and to the release of the energy stored in conventional nuclear spin isomers, which can be de-excited using neutron sources. This invention was made in part with government support under Contract No. W-7405-ENG-36 awarded by the U.S. Department of Energy. The government has certain rights in the invention.

BACKGROUND OF THE INVENTION

Nuclear isomers are long-lived nuclear excited states that have the same atomic and mass numbers as those of the ground state. Isomers were discovered in 1921 and are currently believed to exist as a consequence of a low excitation energy and a high spin quantum number, I. This combination of low excitation energy and high spin makes the decay of nuclear isomers by γ-ray emission or by conversion-electron emission much slower than for conventional excited states. Because high spin is partly responsible for their long lifetime, such nuclear isomers are frequently called spin isomers (or K-isomers). A nuclear isomer having a lifetime of 44 years, such as $^{178m}$Hf, combines a high spin (I=16) with a relatively high excitation energy (2.4 MeV), which is still much lower than the neutron separation energy ($S_n$=7.6 MeV) for this species.

Another type of nuclear isomer, $^{242m}$Am, was found in 1962, in attempts to synthesize very heavy elements. See, "Nuclear Fission," A. Michaudon, in Advances in Nuclear Physics, M. Baranger and E. Vogt, Eds. (Plenum Press, 1973), Vol. 6, p. 1. This isomer does not have high spin, has a relatively high excitation energy (2.9 MeV), and was observed to decay by fission, as opposed to γ-ray emission. Since this species is not a spin isomer, these observations were subsequently interpreted to be properties of highly deformed matter. Potential energy surfaces (PES) for actinide nuclei are known to possess a second well for large deformations in addition to a first well at ground-state deformation (see, e.g., Michaudon, supra). The $^{242m}$Am isomer is interpreted as being in a superdeformed (SD) nuclear state when characterized by this second well and, for this reason, is called a shape isomer. The inner barrier in the PES between the first and second wells retards γ-ray decay of shape isomers which, therefore, preferentially decay by fission through the outer barrier. About 25 shape isomers, also called fission isomers, because they decay principally by fission, have been discovered to date for actinide nuclei generally grouped between uranium and curium in the Periodic Table.

Since 1986, many SD rotational bands have been observed for nuclei having masses between A≈150 and A≈190 (generated using heavy-ion-induced reactions). The results of PES calculations strongly suggest the existence of a second well in the PES for these nuclei. See, e.g., "Superdeformed Nuclei," Robert V. F. Janssens and Teng Lek Khoo, Annu. Rev. Nucl. Part. Sci. 41, 321 (1991). Therefore, shape isomers, similar to fission isomers but with smaller atomic numbers, are likely to exist in the A≈150 and A≈190 mass regions, but their decay by fission is inhibited by their outer fission barrier, which is much higher than for actinide nuclei. Although less likely, shape isomers may also exist in other mass regions. Most postulated shape isomers are expected to have an excitation energy $E_{exc}$ smaller than $S_n$ and would decay by γ-ray emission in a similar manner to spin isomers.

Some shape isomers may have an energy $E_{exc}$ greater than $S_n$, however. This property, which makes the decay of these isomers by spontaneous neutron emission possible, is supported by PES calculations for nuclei in the A=200 region. For example, some mercury isotopes have shown deep second wells with $E_{exc}$ of the order of 10 MeV. Other nuclei may present similar properties. See, e.g., "Super-Deformation and Shape Isomerism: Mapping the Isthmus," by S. J. Krieger et al., Nucl. Phys. A542, 43 (1992) and "Isomères De Forme Dans Les Noyaux Pairs-Pairs: Première Sélection De Candidats Dans La Région De Masses A<208," by Michel Girod et al., Centre d'Études de Bruyères-le-Châtel Note No. CEA-N-2560 (May, 1998). The neutron decay of these shape isomers should make it possible for them to be useful for both neutron and energy sources. Shape isomers having $E_{exc}<S_n$ may also be of interest. For convenience, $(N,Z)_{n,is}$ shape isomers that have neutron number N, proton number Z, and $E_{exc}>S_n$ ($E_{exc}<S_n$) are called N-isomers (n-isomers) in what follows.

An incident neutron interacting with an isomeric state may be inelastically scattered with an outgoing energy greater than the incident energy because the initial isomeric state of the nucleus can make a transition to a lower-energy state during the interaction. This type of neutron acceleration (called superinelastic scattering), which cannot occur for target nuclei in their ground state, is however predicted by theory and has been experimentally verified for a few spin isomers. For these isomers, neutron acceleration is limited by the small angular momentum carried by the incident neutron, which can therefore cause only low-energy transitions from the isomeric state to other excited states having lower energy, but high spin. In most isomers, states reached in the residual nucleus after neutron acceleration also have a relatively high excitation energy and decay by prompt γ-ray emission, thus liberating most of the energy initially stored in the spin isomer. Superinelastic scattering is also possible with N-isomers with possible greater neutron acceleration than with K-isomers because transitions of the N-isomer to lower-energy states are not limited by the same spin and energy considerations. In addition, the high excitation energy of the N-isomer makes the reaction (n,2n) and neutron multiplication possible, even for incident neutrons with low energies. The exact properties of these reactions depend on the intrinsic properties of the N-isomers (excitation energy and shape of the PES) and on the incident energy of the neutron.

N-isomers have lifetime, yield, and neutron-energy spectrum properties that could make them useful as neutron sources. N-isomers might also be used as neutron multipliers [through the use of (n,2n) reactions] and as "neutron accelerators" (through superinelastic scattering). Such neutron sources, depending on their specific properties and on their availability, could supplement existing neutron sources which rely on radioactive substances mixed with materials with a low neutron-emission threshold (like beryllium), or on fission (like $^{252}$Cf). As an example, a source containing 1 g of N-isomers having A≈190 and a lifetime of 1 yr. would emit neutrons at a rate of about $10^{14}$ n/s and low-energy γ-rays at a similar rate. By comparison, a $^{252}$Cf fission source emits at most about $10^{10}$ n/s (for a quantity of 5 mg), which is 4 orders of magnitude below the above intensity quoted for N-isomers. Large quantities of $^{252}$Cf are unavailable because these nuclei are generated from a long neutron-irradiation chain, which involves a sequence of ten neutron captures with four intervening β-decays after the process is started with the irradiation of $^{242}$Pu in the high neutron flux of a fission reactor. It is anticipated that the formation of N-isomers would be simpler than for the formation of $^{252}$Cf and that larger quantities of N-isomers are possible to produce than can presently be obtained for $^{252}$Cf. Radioactive neutron sources based on (a,n) reactions induced by α-ray emitters can produce up to about $10^8$ n/s and are therefore less intense by about 2 orders of magnitude than $^{252}$Cf sources. The energy of the neutrons emitted by N-isomers is difficult to predict, because it partly depends on the energy difference $E_{exc}$-$S_n$. Therefore, neutron sources based on N-isomers have potential as intense neutron sources beyond that which is possible from existing neutron sources. Because of the nature of the phenomenon of neutron acceleration, N-isomers and n-isomers could also be used to harden the energy-spectrum of neutron sources more effectively than K-isomers.

Neutrons emitted by N-isomers could release energy through loss of kinetic energy by nuclear collisions in the source. But additional energy could also be liberated as a result of reactions induced by the emitted neutrons in the source itself or in materials included in the source. Such energy sources might be bulky because of the long mean-free-path of neutrons in matter. Energy may be released from γ-rays emitted by neutron radiative capture or neutron inelastic scattering in the source materials. The magnitude of the capture cross sections and the total energy and multiplicity of the capture γ-rays would be important criteria in selecting suitable materials. Radiative-capture rates could be increased by decreasing neutron energy using hydrogenous compounds in the source as neutron moderators. As an illustration, an N-isomer neutron source emitting $10^{14}$ n/s would generate about 100 W per g of N-isomers from capture γ-rays, assuming that all emitted neutrons would be absorbed by radiative capture. By comparison, a $^{252}$Cf source produces 39 W/g from spontaneous fission (3 times less) but, as noted above, this source cannot be produced in large quantities. The α-radioactivity of $^{238}$Pu is currently used as an energy source but produces 0.6 W/g, a factor of about 65 below that of $^{252}$Cf. Larger energy release from N-isomers is also possible by using the emitted neutrons from the source to induce fission in a fissionable material added to the source, but with the disadvantage of producing fission products, as for $^{252}$Cf .

Inclusion of K-isomers in the source might also generate additional energy by liberating the huge stored energy in these isomers, using reactions induced by neutrons emitted by the N-isomers. As an illustration, an energy of $1.3\times10^3$ MJ would be stored in 1 g of $^{178m}$Hf. These neutrons could cause the K-isomers to make transition to excited states which would subsequently decay to the ground state by γ-ray emission, thereby releasing energy, while one neutron would be re-emitted in this interaction. This same neutron could then be used to release energy through other similar interactions or radiative capture.

Accordingly, it is an object of the present invention to use N-isomers as a source of spontaneous neutrons and as a source of energy.

Yet another object of the invention is to use neutrons emitted from N-isomers, or from another neutron source, to liberate the energy stored in K-isomers to supplement energy sources derived from radiative capture, fission, or other reactions in materials included in the source.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the method for generating neutrons and producing energy from nuclear shape isomers and nuclear spin isomers hereof includes the steps of producing long-lived, nuclear shape isomers located in the second well of a deformation PES possessing two wells, such that decay by fission is inhibited, while decay by neutron emission can occur. Neutron acceleration may occur by superinelastic scattering from the shape and spin isomers themselves and neutron multiplication may occur through (n,2n) reactions induced in the shape isomers themselves or in materials like beryllium added to the source.

In another aspect of the present invention, in accordance with its objects and purposes, the method for generating energy from nuclear shape isomers by using the neutrons spontaneously emitted therefrom to initiate nuclear reactions in the shape isomers themselves, and also in materials added to the source. These reactions include inelastic scattering, radiative capture, and fission. Of special interest among the materials added to the source are K-isomers whose stored energy could be liberated by inelastic scattering of the neutrons emitted by the N-isomers or by any other neutron source.

BRIEF DESCRIPTION OF THE DRAWING

The accompanying FIGURE, which is incorporated in and form a part of the specification, illustrates an embodiment of the present invention and, together with the description, serves to explain the principles of the invention.

The FIGURE shows the potential energy for $^{198}$Hg and for $^{240}$Pu as a function of the deformation parameter, which is used to describe the amount of quadrupole nuclear deformations such as the relative difference between the nuclear radius along the elongation axis and that along an axis perpendicular to the elongation axis.

DETAILED DESCRIPTION

Briefly, the present invention includes the use of N-isomers as a source of energy and of neutrons, and the use of K-isomers as a source of energy induced by neutrons introduced into a sample thereof. It is anticipated that isotopes of mercury and nearby elements in the Periodic Table will provide a source of N-isomers. Shape isomers may however be found in other areas of the Periodic Table. Reference will now be made in detail to the present preferred embodiment of the invention, an example of which is shown in the accompanying FIGURE.

Super-deformed (SD) states of nuclear matter are caused by the existence of a second well in the potential energy versus deformation, for these nuclei, as shown in the FIGURE. The potential energy (PE) curve shown represents a cut of the PES through the two wells. Shape isomers exist in the second (outer) well of the PES. Shape isomers in actinide nuclei can easily penetrate the outer barrier of their PES, which is relatively low, and decay by fission. For this reason, these SD states are often called fission isomers. Decay of the SD states by penetration through the inner barrier toward states in the first well is also possible but is less frequent than is decay by fission. The shape of the barrier varies from one nucleus to another and can result in large variations in the properties of fission isomers because of the great sensitivity of these properties to small changes in the PES. For example, variations by several orders of magnitude in lifetime can be observed in fission isomers differing only by one proton or one neutron. Such variations are called odd-even effects.

There is substantial evidence from PES calculations and from experiments using heavy-ion-induced (HI) reactions that SD states can also exist for nuclei lighter than actinides; for example, in mercury isotopes. The PES for such nuclei exhibit a second well as is shown in the FIGURE which, as stated, is responsible for the existence of SD states. However, their PESs have shapes which are different from those of the actinides. As a consequence, properties of the SD states for mercury isotopes (and similar nuclei) are expected to be different from those for actinides. To illustrate these differences, the PE for $^{240}$Pu, which has a fission isomer, and for $^{198}$Hg, which is expected to have a shape isomer, are plotted in the FIGURE. Although the mass difference between these two nuclei is only $\Delta A=42$, there are some substantial differences in the two PE curves. Both PEs present a second minimum, which makes possible the existence of SD states, but the second minimum for $^{198}$Hg occurs at a smaller deformation than that for $^{240}$Pu. Moreover, the energy of the second minimum, $E_{II}$, occurs at a higher energy for $^{198}$Hg than for $^{240}$Pu. The energy $E_{II}$ is small for fission isomers ($E_{II}$=2.2 MeV for $^{240}$Pu) and is always below the neutron separation energy, $S_n$ ($S_n$=6.5 MeV for $^{240}$Pu). By contrast to the actinides, the energy $E_{II}$, can be above $S_n$ for some lighter nuclei. This is what is predicted by theory for $^{198}$Hg, for which $E_{II}\approx 10$ MeV, while $S_n$=8.5 MeV. Decay of SD states by neutron emission is therefore possible for those nuclei having $E_{II}>S_n$. Additionally, the outer barrier is low for actinides. As stated, this is the reason shape isomers in actinides preferentially decay by fission. By contrast to fission isomers, SD states in lighter nuclei possess a higher outer barrier which significantly reduces their decay by fission. The outer barrier for $^{198}$Hg lies between 20 and 50 MeV. For such nuclei, decay of the SD state occurs only by γ-ray emission and also by neutron emission when $E_{II}>S_n$.

Although there is strong indirect evidence for the existence of shape isomers in nuclei lighter than actinides, SD isomeric states have not yet been directly observed. What has been observed, however, are rotational bands from these SD states through γ-ray transitions within high-energy rotational states of this band, as populated by HI reactions (See, Janssens and Khoo, supra). However, the γ-ray transitions within SD rotational states terminate before reaching the SD ground state (the shape isomer) and continue through transitions between states located in the first well.

In addition to formation by HI reactions, shape isomers could also be populated through neutron- or proton-induced reactions using high-intensity accelerated proton beams or high fluxes of fast neutrons produced through spallation reactions induced by these high-intensity proton beams. The quantities of shape isomers produced using these reactions cannot presently be accurately calculated since the cross sections for the formation of these SD states are unknown. The quantities are anticipated to be small, but are expected to be larger than those obtained from HI reactions and may be enhanced by reaction mechanisms such as vibrational resonances, which have been observed in fission. The lifetimes for the shape isomers are likely to be small as well, but may be increased by effects such as the odd-even effects observed for fission isomers.

Having generally described the invention, the following EXAMPLE will provide additional details.

EXAMPLE

In the practice of the present invention, the following steps are proposed:

(1) Identification of N-isomers and K-isomers of interest: Theoretical methods are presently available for calculating the multidimensional PES for nuclei that are likely to provide N-isomers, and for reaction mechanisms most suitable for the formation of such isomers. These methods are either of the macroscopic-microscopic or of the purely microscopic types. Methods of the latter type are more sophisticated than those of the former type, but they require lengthy computer calculations. Nuclei for which PES calculations indicate the existence of N-isomers will be generated. Included will be neutron-induced reactions such as (n,γ) or (n,zn), charged-particle-induced reactions such as (p,n) or (p,zn), where z represents all particles (including neutrons) or γ-rays emitted in addition to one neutron, and HI-induced reactions. The formation of N-isomers can be identified from their decay by neutron and subsequent prompt γ-ray emission, which provides the signature of the residual nucleus after neutron emission by the N-isomer. Formation of K-isomers can be observed from their γ-ray decay, which provides the signature of the decaying nucleus.

(2) Production of N-isomers and K-isomers: The production of K-isomers has been discussed at length in the literature. Because N-isomers have a high excitation energy, they can only be produced by means of nuclear reactions, such as those induced by neutrons or charged particles. Moreover, nuclear reactions with high cross sections using incident particles available in high intensities or fluxes must be used to obtain substantial quantities of N-isomers. The magnitude of the cross sections for N-isomer production may vary greatly. Methods currently employed for the calculation of fission-isomer production could be adapted to the calculation of cross sections for the production of N-isomers. These cross sections are expected to be low but could be greatly enhanced by the existence of vibrational resonances.

Neutrons, available in high fluxes in fission reactors, are envisaged for the production of N-isomers. For example, (n,γ) reactions could be used in a sample of (N-1,Z) nuclei irradiated in a high neutron flux. Thermal neutrons are unlikely to be of practical use however because there is a very small probability that any N-isomer would have an energy $E_{exc}$ greater than $S_n$ by only a fraction of an eV, which is the approximate energy of thermal neutrons. Fast neutrons should produce N-isomers as long as sufficient neutrons having incident energies $E_n \geqq E_{exc}-S_n$ are available. Fission reactors generate primary fission neutrons having a wide energy spectrum and a mean energy of about 2 MeV, but most of this energy is lost to inelastic collisions in the reactor materials, which includes the nuclear fuel. For these reasons, fission reactors do not seem to be of much practical use for the production of N-isomers.

Other high-flux neutron sources derive from reactions induced by intense charged-particle beams delivered by accelerators; for example, intense 14-MeV neutrons are generated from D-T reactions induced by high-current deuteron beams in tritium targets. Spallation-neutron sources using high-current proton beams of about 1 GeV are also of interest because these sources provide more suitable neutron fluxes than nuclear reactors. The neutron spectrum of spallation-neutron sources can extend into the GeV range which is about 2 to 3 orders of magnitude above the energies of reactor neutrons. A spallation-neutron source using a proton current of about 1 mA already exists with a thermal-neutron flux comparable with that of a high-flux reactor, and with fast neutrons with energies beyond the reach of reactors. Spallation-neutron sources with proton currents of about 200 mA, are within the reach of existing technology. Therefore, spallation-neutron sources can provide neutrons having energies and intensities unmatched by nuclear reactors. A great variety of nuclear reactions can be induced with these high-energy neutrons.

High currents of charged-particle beams available from accelerators can also be used directly for the production of N-isomers. For example, the primary proton beam of spallation-neutron sources could be used for proton-induced reactions, such as (p,n) or (p,zn) reactions, to produce N-isomers. Proton-induced reactions and neutron-induced reactions would supplement each other in accessing different (N,Z) regions where N-isomers may exist, using available targets. HI-induced reactions can also produce N-isomers in (N,Z) regions that cannot be reached with nucleon-induced reactions; however, these HI reactions are associated with high angular momentum, which can prohibit the formation of N-isomers with the desired spin. Moreover, HI beams are produced with small currents and deposit large heat in target samples because of the short range of heavy ions in matter. These drawbacks may prevent the use of HI reactions for the production of N-isomers in ponderable quantities.

(3) Separation of N-isomers and K-isomers from other nuclei: Targets used for the production of N-isomers and K-isomers may or may not be monoisotopic. Even if targets were to be monoisotopic, N-isomers and K-isomers will be formed and mixed with target nuclei and reaction products. Even more nuclei will be formed if targets are composed of several isotopes (e.g., like mercury). In the case of mercury, PES calculations show that Hg isotopes with mass numbers between A=198 and 200 are good candidates to look for N-isomers because the energy $E_{II}$ of the second well of these isotopes is above $S_n$. N-isomers in mercury could a priori easily be obtained from neutron irradiation of natural mercury, which has isotopes with 196<A<204, using (n,xn) reactions (x here is the total number of neutrons emitted in the reaction).

Chemical separation can be used to separate elements having different atomic numbers. This method could be associated with a selective reaction mechanism in the formation of N-isomers and K-isomers. Gaseous diffusion, centrifugation, electromagnetic separation, and laser separation can be used for separation of isotopes of a given element. Separation of N-isomers $(N,Z)_{n,is}$ from ground state (N,Z) nuclei is however more challenging. Such $(N,Z)_{n,is}$ isomers are heavier by about 8 MeV (with fluctuations from nucleus to nucleus) than the same (N,Z) nuclei in their ground state which have a rest mass of 140 to 175 GeV and a relative mass difference of about $5\times10^{-5}$. The small mass difference between $(N,Z)_{n,is}$ and (N,Z) nuclei therefore cannot be used in conventional mass-separation techniques with the possible exception of high-resolution electromagnetic beam-optics techniques. Other, more sophisticated techniques based, for example, on laser spectroscopy or on the Szilard-Chalmers effect, could however be envisaged.

(4) Properties of N-isomers and K-isomers: The lifetime of the N-isomers and the energy-spectrum of the neutrons emitted by these isomers are the principal properties to investigate, since these properties determine whether an N-isomer can be utilized as an energy and neutron source. These studies would be extended to those of (n,2n) reactions below the threshold $E_{th}\approx S_n$ of conventional (n,2n) reactions because neutrons having energies below $S_n$ can induce (n,2n) reactions in N-isomers. These reactions could therefore be observed with great sensitivity even in the presence of other nuclei, i.e., with samples containing small amounts of the N-isomers, and would provide additional evidence of the presence of the N-isomers in the sample.

(5) Macroscopic studies of neutron and energy sources based on the N-isomers and of energy sources based on K-isomers: If sufficient N-isomer material can be assembled, macroscopic tests of neutron and energy release can be carried out. Although the properties of N-isomer neutron sources can be extrapolated from the microscopic studies discussed above, heat generated from neutrons emitted by N-isomers combined with other materials is difficult to predict because it depends not only on the intrinsic properties of the neutron emitters but also on the materials that would be included in the source and on the cross sections of the various processes involved in the energy release. Sources for generating energy would be studied in a similar manner, where K-isomers would be de-excited by neutron sources within the sample.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for generating neutrons, which comprises the step of generating long-lived, nuclear shape isomers having a deformation potential energy surface which includes two wells, the outer well being flanked by an inner energy barrier and an energy outer barrier, where the outer energy barrier is sufficiently high and the inner energy barrier is sufficiently low that decay by fission is inhibited while decay by neutron emission occurs.

2. The method for generating neutrons as described in claim 1, further comprising the step of separating the long-lived, nuclear shape isomers from parent nuclei and from unwanted nuclei generated from said step of generating the nuclear shape isomers.

3. The method for generating neutrons as described in claim 1, further comprising the step of mixing the long-lived, nuclear shape isomers generated in said step of generating the nuclear shape isomers with materials whereby neutron multiplication occurs by (n,2n) reactions in the nuclear shape isomers and in the materials.

4. The method for generating neutrons as described in claim 1, wherein the generated neutrons are accelerated by superinelastic neutron scattering by the long-lived, nuclear shape isomers.

5. The method for generating neutrons as described in claim 1, wherein the nuclear shape isomers are generated using nuclear reactions with incident particles available in high intensities where the nuclear reactions have high cross sections.

* * * * *